United States Patent [19]

Suzuki

[11] Patent Number: 4,735,369

[45] Date of Patent: Apr. 5, 1988

[54] METHOD OF FINDING YARN END

[75] Inventor: Tadashi Suzuki, Kyoto, Japan

[73] Assignee: Murata Kikai Kabushiki Kaisha, Kyoto, Japan

[21] Appl. No.: 905,743

[22] Filed: Sep. 9, 1986

[30] Foreign Application Priority Data

Sep. 10, 1985 [JP] Japan ..... 60-200879

[51] Int. Cl.[4] ..... B65H 54/00

[52] U.S. Cl. ..... 242/18 R; 242/35.5 R; 242/35.6 R; 242/35.6 E

[58] Field of Search ..... 242/35.6 E, 35.6 R, 242/35.5 R, 35.5 A, 18 R

[56] References Cited

U.S. PATENT DOCUMENTS

| | | | |
|---|---|---|---|
| 2,675,971 | 4/1954 | Abbott | 242/35.6 R |
| 3,224,694 | 12/1965 | Oishi | 242/35.5 R |
| 3,398,906 | 8/1968 | Bell | 242/35.6 E |
| 3,544,018 | 12/1970 | Stoppard et al. | 242/35.6 R |
| 3,727,852 | 4/1973 | Nelson et al. | 242/35.6 R |
| 3,897,022 | 7/1975 | Savio | 242/35.6 E |
| 3,941,323 | 3/1976 | D'Agnolo et al. | 242/35.6 E X |
| 4,576,341 | 3/1986 | Matsui et al. | 242/35.5 A |
| 4,616,789 | 10/1986 | Matsui et al. | 242/35.5 R |

*Primary Examiner*—Stanley N. Gilreath

*Attorney, Agent, or Firm*—Spensley Horn Jubas & Lubitz

[57] ABSTRACT

A method of yarn end finding for a yarn end finding device which includes a contacting device for drawing out a yarn end from a bobbin by positively contacting the surface of a yarn layer thereof. It comprises operating the contacting device so that the contacting device does not act on bobbins passed through the yarn end finding device for the first time but acts on bobbins passed through the yarn end finding device at least two times.

16 Claims, 7 Drawing Sheets

METHOD OF FINDING YARN END

FIELD OF THE INVENTION AND RELATED ART STATEMENT

The present invention relates to a method of finding a yarn end.

Spinning bobbins produced by a spinning frame are subjected to loosening of a bunch winding and drawing out of a length of yarn end, prior to supplied to the subsequent rewinding step, namely, to an automatic winder. For this purpose, in general, a yarn end finding device is provided on the bobbin supply side of the automatic winder.

The bunch winding is classified into the top bunch in which a yarn is wound around a top part of a bobbin and a bottom bunch in which a yarn is wound around a bottom part of a bobbin. In any case, in the yarn end finding device, the bunch winding is loosened or removed, thereafter a predetermined length of yarn end is drawn out from a yarn layer, and is inserted into a center hole of the bobbin, or lightly wound several times around the surface of the yarn layer, or alternatively, the bobbin is thrown into a bobbin stock magazine and the yarn end is sucked into and held by a suction pipe provided at the center of the magazine, each of these treatment being conducted selectively depending on the type of the winder.

In a device for drawing out the predetermined length of yarn end, a suction mouth is brought close to the surface of the yarn layer on a bobbin to draw out the yarn end by suction. In this case, where the yarn end bites into the yarn layer or the leading end of the yarn end is in contact with and entangled around the surface of the yarn layer, the yarn end sometimes cannot be separated from the yarn layer by the suction alone. To cope with this, a beater device is provided for positive finding and easy separation of the yarn end on the surface of the yarn layer. In one example of the beater device, elastic contact pieces such as rubber plates are fixed to the peripheral surface of a rotary shaft in a radial manner, and the rubber plates are rotated to contact the surface of the yarn layer on the bobbin to separate the yarn end, thereby facilitating sucking the yarn end.

In the beater device of the type mentioned above, since the contact pieces rotated in one direction positively strike the surface of the yarn layer on the bobbin to accelerate the separation of the yarn end, there is a drawback that the surface of the yarn layer is damaged. Particularly, the fact that the contact pieces strike also the surface of the yarn layer on those bobbins from which the yarn end can be easily separated by the suction air flow without need for use of the beater device, not only leads to damage on the yarn layer but is of no use.

OBJECT AND SUMMARY OF THE INVENTION

It is an object of the present invention to provide a method of finding yarn end, in which a possibility of damage on the surface of the yarn layer is lowered.

The preferred embodiment of the present invention is, in a yarn end finding device comprising a contacting device for loosening a yarn end by positively contacting the surface of a yarn layer, a method of finding a yarn end which comprises operating the contacting device so that the contacting device does not act on bobbins passed through the yarn end finding device for the first time but acts on bobbins passed through the yarn end finding device at least two times.

The contacting device does not act on bobbins passed through the yarn end finding device for the first time but acts on bobbins for which the yarn end finding operation has been unsuccessful and which are again passed through the yarn end finding device. Thus, the beater acts on those bobbins for which the yarn end finding operation is difficult to carry out, and, accordingly, the yarn layers on ordinary bobbins are not damaged, and motion of the contacting device itself is saved, leading to a longer use life of the contacting device.

BRIEF DESCRIPTION OF THE DRAWINGS

FIGS. 6 to 9 illustrate the bypass feeding operation for the bobbin for which the yarn end finding operation has been unsuccessful, wherein FIG. 6 shows a model plan of an example of assigning ports on the rotary plate, FIG. 7 illustrates the condition in which the rotary plate has been rotated one pitch, FIG. 8 shows a circuit diagram for bypass feeding, FIG. 9 shows a flow chart for driving the beater device.

DETAILED DESCRIPTION OF PREFERRED EMBODIMENTS

Figure 1:
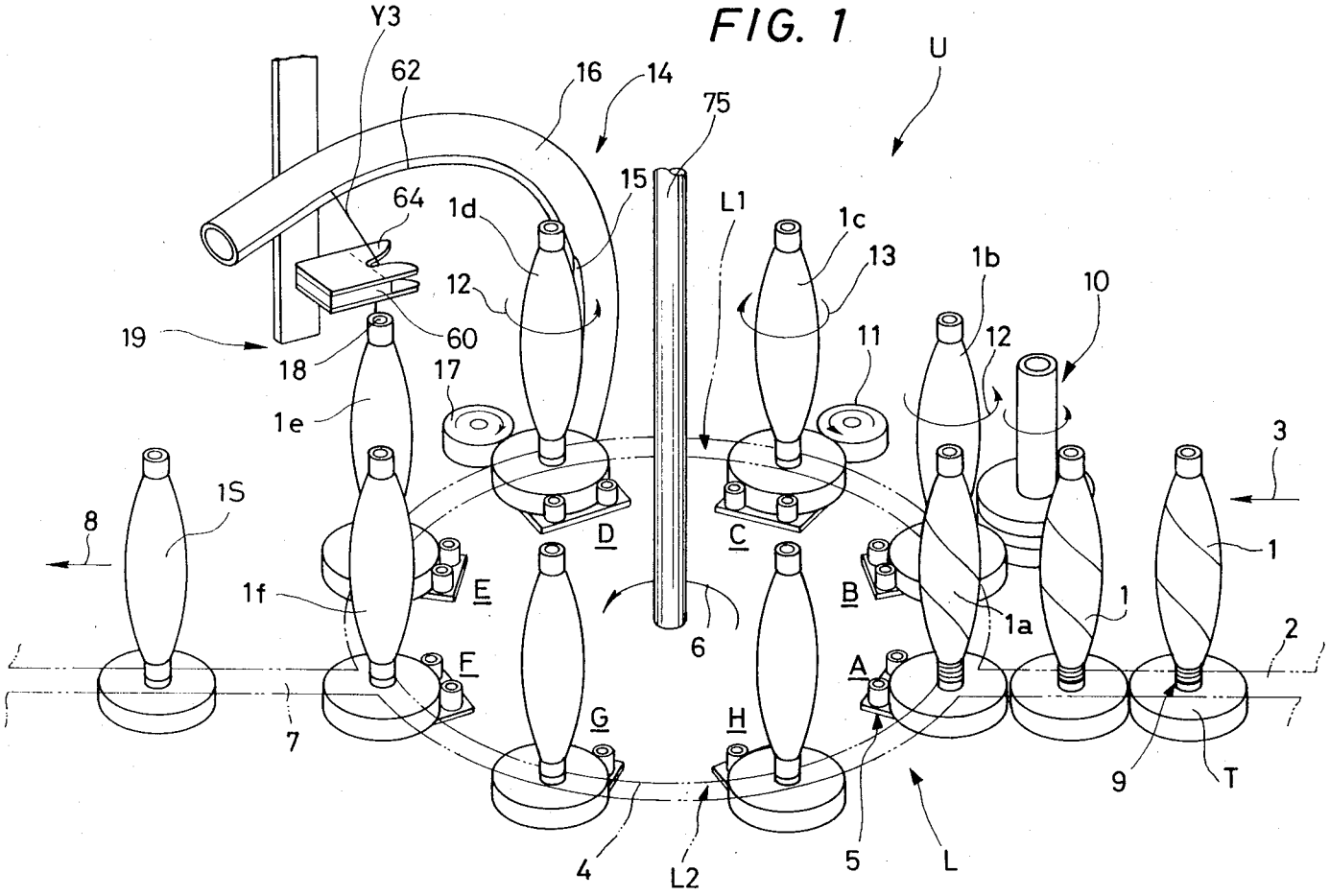
FIG. 1 shows a schematic perspective construction view of an embodiment of the yarn end finding device.

A working example of the preferred embodiment of the present invention will now be described below while referring to the drawings.

Figure 2:
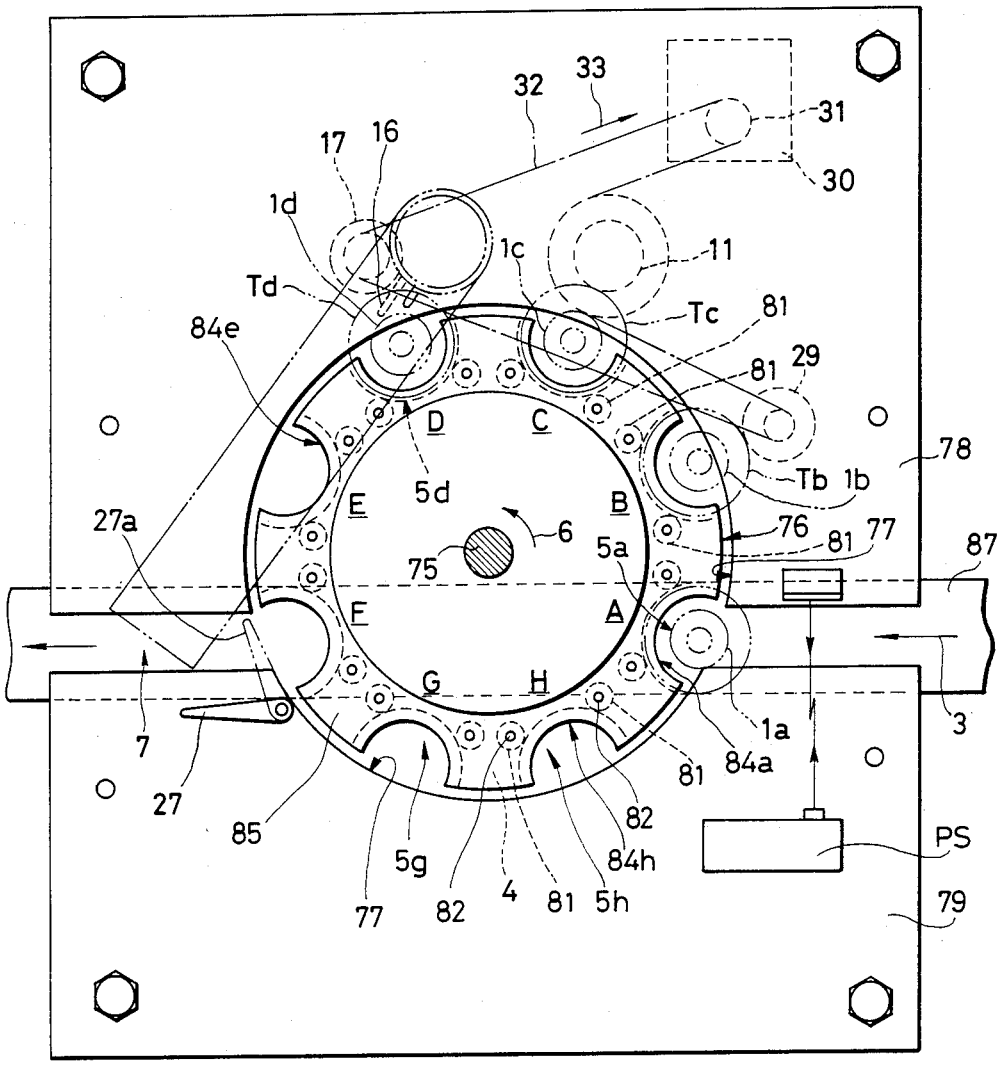
FIG. 2 shows a plan view of the same embodiment.

FIGS. 1 and 2 show an embodiment of the yarn end finding device. The device U is of the type in which while erecting the bobbins 1 on trays for individually separately feeding the bobbins 1, a bottom bunch 9 is loosened and a yarn end is found, followed by inserting the yarn end down into a center hole of a take-up tube 18 from the top end of the bobbin 1; however, the present invention is applicable also to a yarn end finding device of the type designed for bobbins with top bunch, the type in which the top end of the bobbin is gripped by a chuck device and a yarn end is found while the bobbin is once lifted up from the tray T, of the type designed for finding the yarn end on bobbins moved on a straight line, or of other type.

In FIG. 1, an annular feed line L is disposed in the cource of feed lines 2, 7 for bobbins 1, and is connected to the feed line 2 at a receiving station A and to the feed line 7 at a bobbin delivery station F. A part L1 of the line L is used as a yarn finding line, while the remainder L2 is used as a feed-back line for the bobbins for which the yarn end finding operation has been unsuccessful. Namely, the line L1 extends in the direction of an arrow 6 from station A to station F, while the line L2 extends in the same direction from station F to station A.

The spinning bobbins 1 in the state of being erected on the trays T are fed along the feed line 2 in the direction of an arrow 3 to the receiving position A of the yarn end finding device. The bobbin 1*a* received by one of tray-receiving parts 5 fixed at regular intervals on a rotary plate 4 of the yarn end finding device are fed through treating stations B, C, D and E to the delivery station F as the rotary plate 4 is intermittently rotated in the direction of arrow 6, and the bobbin 1*s* for which the yarn end finding operation has been successful is fed along a feed line 7 in the direction of arrow 8 toward the winder.

At the station B is disposed a cutter device 10 for loosening and cutting a bunch winding 9 on the bottom part of the bobbin, and at the station C is disposed a roller 11 for lightly winding a yarn extending between the bobbin 1*c* and the cutter 10 around the surface of the yarn layer. At the station B, the bobbin 1*c* is rotated by a friction roller in the direction 12 for loosening the yarn wound thereon, and at the station C the bobbin is rotated by the roller 11 in the direction 13 for winding the yarn. Further, at station D is provided a yarn end sucking and loosening device 14 for sucking and loosening the yarn end in the free state, the device being constituted of, for instance, a suction mouth 16 having a slit 15. At this position, the bobbin 1*d* is rotated by a friction roller 17 in the direction 12 for loosening the yarn. In addition, the contacting device which will be described later is provided at the station D. At station E is provided a yarn end inserting mechanism 19 for cutting the yarn drawn out from the bobbin to a predetermined length and inserting the yarn end into the center hole 18 of the bobbin 1*e*.

As the rotary plate 4 is rotated intermittently by 45° at a time in the direction of arrow 6, the tray TA with the bobbin erected thereon arriving at the receiving position A is fed through the treating stations B to E to arrive at the delivery position F. At this position F, a bobbin for which the yarn end finding operation has been successful is delivered into the feed line 7, whereas a bobbin for which the operation has been unsuccessful is blocked by a movable guide 27*a*, then fed through the line L2 to again arrive at the receiving position A for yarn end finding and is subjected to the same process as above. Namely, a sensor for detecting a found yarn end is provided at the treating station E, and when the absence of the yarn end is detected by the sensor, a movable guide 27 shown in FIG. 2 is positioned at position 27*a* by a rotary solenoid or the like to inhibit the delivery of the tray Tf arriving at the position F.

FIG. 2 also shows friction rollers 29, 11 and 17 for rotating the bobbins at the treating stations B, C and D, respectively, and a drive source 30 for the rollers. An endless belt 32 is fitted between an output pulley 31 for a motor 30 and each of the rollers 29, 11, 17, and as the belt 32 is moved in the direction of arrow 33 the rollers 29, 11, 17 are rotated in predetermined directions. The rollers 29 and 17 contact and rotate the trays Tb and Td in the direction for loosening the yarn on the bobbin, while the roller 11 rotates the tray Tc in the direction for winding the yarn on the bobbin.

Figure 3:
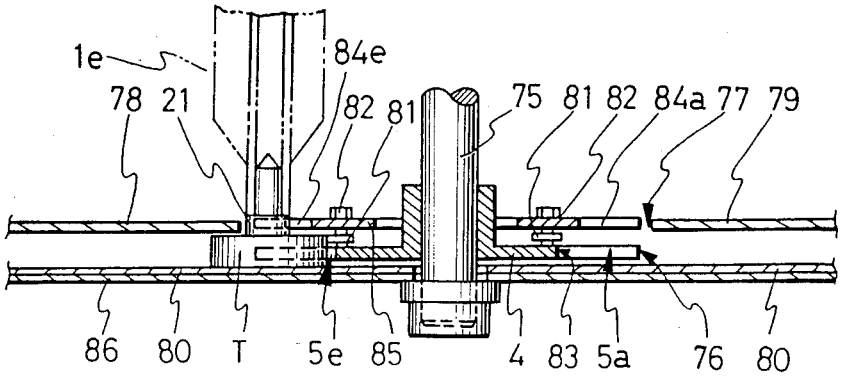
FIG. 3 shows a partially sectional front view of the same embodiment.

In FIGS. 1 to 3, the rotary plate 4 provided with tray-receiving grooves 5*a* to 5*h* at regular pitch along the periphery thereof is fixed to a vertically extending shaft 75, and outer guide plates 78 and 79 having a guide surface 77 concentrical with and slightly spaced from an imaginary outer peripheral surface 76 of the rotary plate 4 is fixed to a main body frame so that a tray feed line is constituted of the receiving grooves 5*a* to 5*h*, the guide plates 78 and 79, a plate 80, etc.

The tray-receiving grooves 5*a* to 5*h* are each constituted of a half part of a circle having a diameter approximately equal to that of the tray; in this example, eight tray-receiving grooves 5*a* to 5*h* are provided at a pitch of 45°.

Furthermore, at two positions in the periphery of each of the receiving grooves, a pair of rollers 81, 81 for smooth positioning of the tray and smooth rotation of the tray at the treating station are provided respectively on shafts 82, 82. The surfaces of contact of the rollers 81, 81 with the tray are slightly protruded beyond the peripheral surfaces 83 of the receiving grooves, so that the outer peripheral surface of the tray does never make total contact with the inner peripheral surface of the receiving groove.

On the upper side of and slightly spaced from the rotary plate 4, a guide plate 85 provided with arcuate grooves 84*a* to 84*h* at positions corresponding to the receiving grooves is fixed onto the shafts 82, 82 of the rollers 81, 81 so that, as shown in FIG. 3, each of the arcuate grooves 84*a* to 84*h* is located at the part of a support 21 of the tray T to prevent the tray from falling down or jumping up during feeding thereof.

Figure 4:
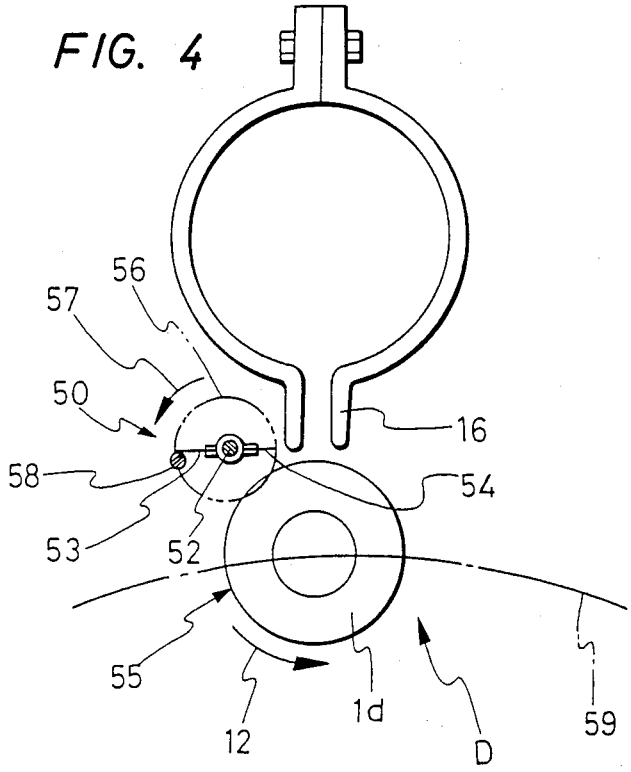
FIG. 4 shows a plan view of an embodiment of a beater device.
Figure 5:
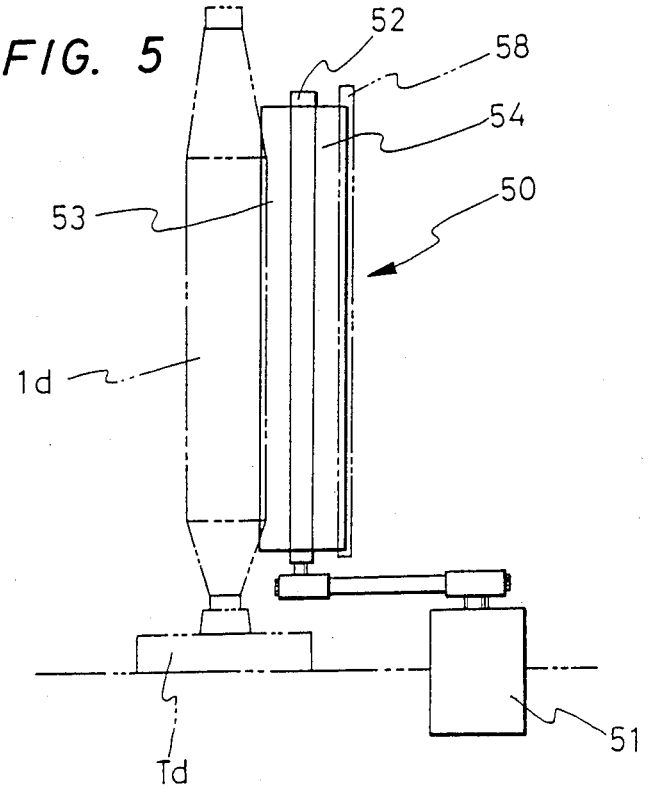
FIG. 5 shows a front view of the same.

An embodiment of the contacting device provided at the station D is shown in FIGS. 4 and 5. The beater device 50 is disposed in proximity to the suction mouth 16, and comprises two beaters 53 and 54 consisting of elastic friction members such as rubber plates which are fixed to a rotary shaft 52 rotated by a motor 51, at straight angles (180°) to each other. The rotary shaft 52 is set at such a position that a circular locus of rotation 56 of the tip of the rubber plate intersects with the outer peripheral surface 55 of the yarn layer on the bobbin 1*d* stopped and positioned at the station D. Therefore, when the bobbin 1*d* is rotated in the direction 12 for loosening the yarn, the beaters 53 and 54 are rotated in the direction of arrow 57, whereby the beaters strike the surface of the yarn layer to accelerate the separation of the yarn end from the yarn layer. Numeral 58 denotes a stopper which is provided at such a position that when the drive of the motor 51 is stopped and the beaters 53 and 54 are rotated due to the slowing-down revolution of the shaft 52, the stopper 58 contacts the beater 53 or 54 to prevent the beater 53 or 54 from rotating beyond the stopper 58 through only the elasticity of the rubber plate. Namely, the stopper 58 acts for positioning the beaters 53, 54 when the motor 51 is turned OFF, and at that position the beaters cannot make contact with the surface 55 of the yarn layer on the bobbin 1*d* when the bobbin is fed along the moving path 59.

The yarn end finding operation of the yarn end finding device having the mechanisms described above will now be explained below.

In FIGS. 1 and 2, the tray Ta supporting thereon a spinning bobbin 1*a* which has been fed on a feed conveyor 87 in the direction of arrow 3 passes on the front side of a phototube sensor PS, and enters the receiving groove 5*a* standing by at the position of the tray-receiving station A of the rotary plate 4. When the passage of the tray is detected by the sensor PS, the rotary plate 4 is rotated one pitch in the direction of arrow 6 with a predetermined delay of time through a timer. Thus, the rotary plate is rotated only on detection of the passage of the tray by the phototube sensor PS, so that the tray is necessarily present in each of the receiving grooves 5*a* to 5*e* at the stations A to E of the rotary plate 4, and there will not appear the empty state at the stations A to E. In this connection, the state where the tray is absent and the state where the tray is present are in some cases coexistent in the receiving grooves 5*g* and 5*h* on the downstream side of the delivery station F. Namely, in the above-mentioned example of the device, as will be described later, the yarn end is wound only passively and lightly by the bobbin for which the yarn end finding operation has been unsuccessful, and the yarn end is never wound so tightly as to make it difficult to draw out the yarn end in the next station.

Next, the bobbin 1*d* arriving at the station D is rotated in the direction for loosening the yarn by the contact of the friction roller 17 with the tray Td, and the yarn end is loosened and sucked by the suction mouth 16 disposed in proximity to the surface of the yarn layer.

Where the bobbin 1*d* at the position is one which is supplied to the yarn end finding device for the first time, the beater device 50 shown in FIG. 4 at the station does not act on the bobbin but remains stationary at a stop position shown in FIG. 4.

The yarn drawn out is moved along the slit 62 shown in FIG. 1, resulting in that a length of the yarn extends between the station D and the slit.

Subsequently, when the bobbin is transferred from the station D to the station E, the yarn Y3 drawn out as above is guided into the cutter device 60 by the guide plate 64, as shown in FIG. 1, to actuate a yarn detecting feeler incorporated in the cutter device. At this moment, a suction air flow is induced in a suction pipe (not shown) disposed on the lower side of the tray Te at the station E, and the yarn end cut at the position of the cutter 60 is sucked into the center hole 18 of the bobbin, whereby the yarn end finding operation is completed.

Accordingly, the bobbin arriving at the station F is delivered onto the feed line 7 for supply to the winder, in the state of being erected on the tray, with a predetermined length of yarn end dropping down into the center hole of the bobbin from the top part of the bobbin.

In this example, the bobbin for which the yarn end finding operation has been unsuccessful is not delivered upon arriving at the station but is fed through bypass stations G and H to again arrive at the station A, as described above. However, a method of simply moving the movable guide (27 in FIG. 2) provided at the station F to the position 27*a* on detection of the absence of the yarn by the yarn detector at the station E involves the problem that when errors in finding the yarn end are repeated for a certain bobbin, the bobbin is endlessly circulated through the stations A to H, which is inefficient.

To avoid this problem, according to the present example, when the number of times of error in finding the yarn end on a specified bobbin reaches a preset number, the movable guide 27 is not operated, and the bobbin is delivered or removed from the station F onto the feed line 7. Namely, a bypass circuit is provided in which it is possible to track the bobbin for which the yarn end finding operation has been unsuccessful. Further, only for the bobbin which is passed through the bypass circuit and again passed through the stations A, B, C, D and E of the yarn end finding device, the beater device at the station D strikes the surface of the yarn layer to accelerate finding of the yarn end.

There are situations in which the yarn end cannot be found by the beater device as previously described. In a bobbin which is not completed the winding operation in a spinning frame, it can not be known where a yarn end is placed on the yarn layer of the bobbin. So, another embodiment of the contacting device is proposed to be provided with the yarn end finding device. In this embodiment a contacting member made of a material having large coefficient of friction is located to be abutted with a yarn layer in pressing contact over all ranges where an end of yarn wound on the bobbin may be positioned. A sandpaper of fine mesh used for grinding and polishing, a rough plate having fine irregular surface, a rubber plate and a fabric material used for removing a waste yarn adhered to clothes and made of a fabric on which a plurality of short fibers are implanted in one direction may be used for the contacting member. The contacting member is contacted with the yarn layer of the bobbin to produce a pull of an entangled yarn end.

Figure 10:
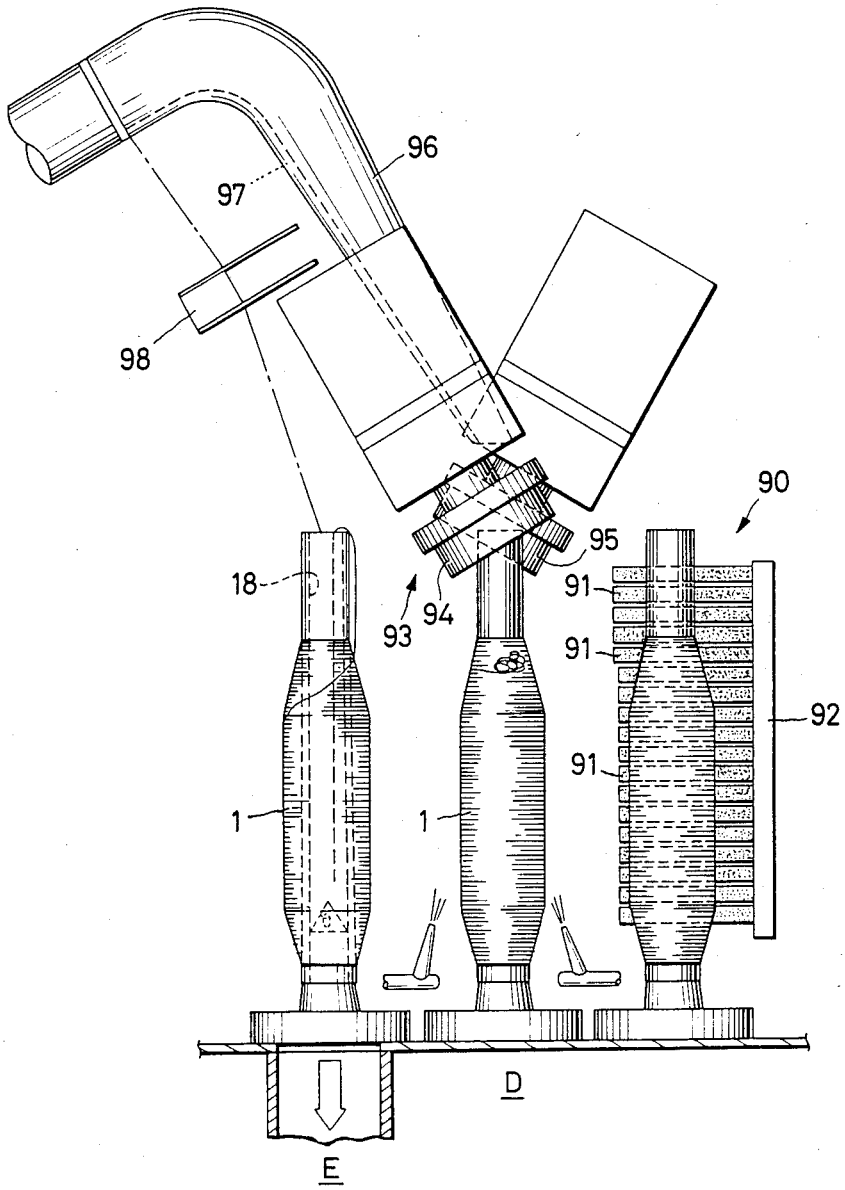
FIG. 10 is a schematic front view partially in section of another embodiment of the yarn end finding device.

This embodiment of the contacting device is shown in FIG. 10. The numeral 90 denotes a contacting member for finding a yarn end of a spinning bobbin 1. The contacting member 90 is formed by a plurality of long strips of sandpaper 91 used for final polishing which are arranged in a row and one end of each of the sandpapers is secured on a supporting arm 92, respectively. The yarn end finding device 93 shown in FIG. 10 is a device used for a bobbin having a top bunch. A yarn end positioned at the bunch winding and loosened from the bunch by inclined rotating rollers 94, 95 is sucked into a suction pipe 96 and is moved to a cutter 98 through a slit 97. A yarn end cut by the cutter 98 is sucked into the center hole 18 of the take-up tube. When the contacting member 90 is provided at the section D in FIG. 1, or provided together with the beater device, the yarn end finding operation can be accomplished more surely.

A bobbin tracking device will now be explained below referring to FIGS. 6 to 8.

Figure 6:
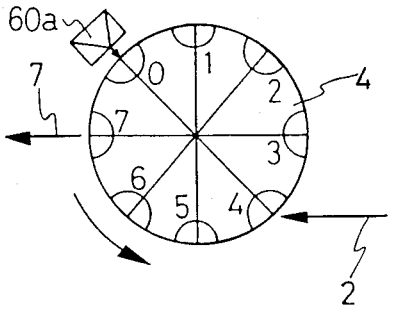

In FIG. 6, the eight bobbin receiving grooves disposed at regular intervals are named ports 0 to 7, respectively. It is assumed that the bobbin receiving groove at the station E provided with the yarn detecting feeler 60*a* is port 0, and the other bobbin receiving grooves as viewed in the direction opposite to the rotation of the rotary plate are ports 1 to 7, respectively. In addition, in FIG. 8, 0 to 7 in a shift register 88 correspond to ports 0 to 7, respectively. Incidentally, in the case of conducting bypass feeding up to two times and delivering onto the feed line 7 the bobbin for which the yarn end finding operation has been unsuccessful three times, each of counters C0 to C7 corresponding respectively to the registers 0 to 7 is set to "3". When an error in finding the yarn end has occurred in the condition of FIG. 6, the shift register 88 starts with 0, and the content of the counter C0 becomes "1" under the AND condition of the register 0 and a yarn end finding error signal. Simultaneously, the yarn end finding error signal is used to drive a solenoid $\overline{so}$ for the movable guide 27, whereby the bobbin is bypass fed.

Figure 7:
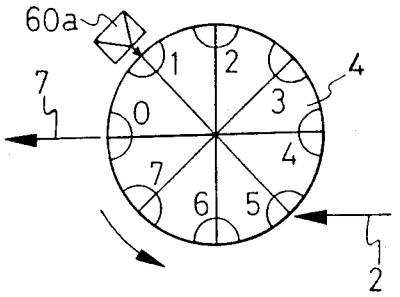
Figure 8:
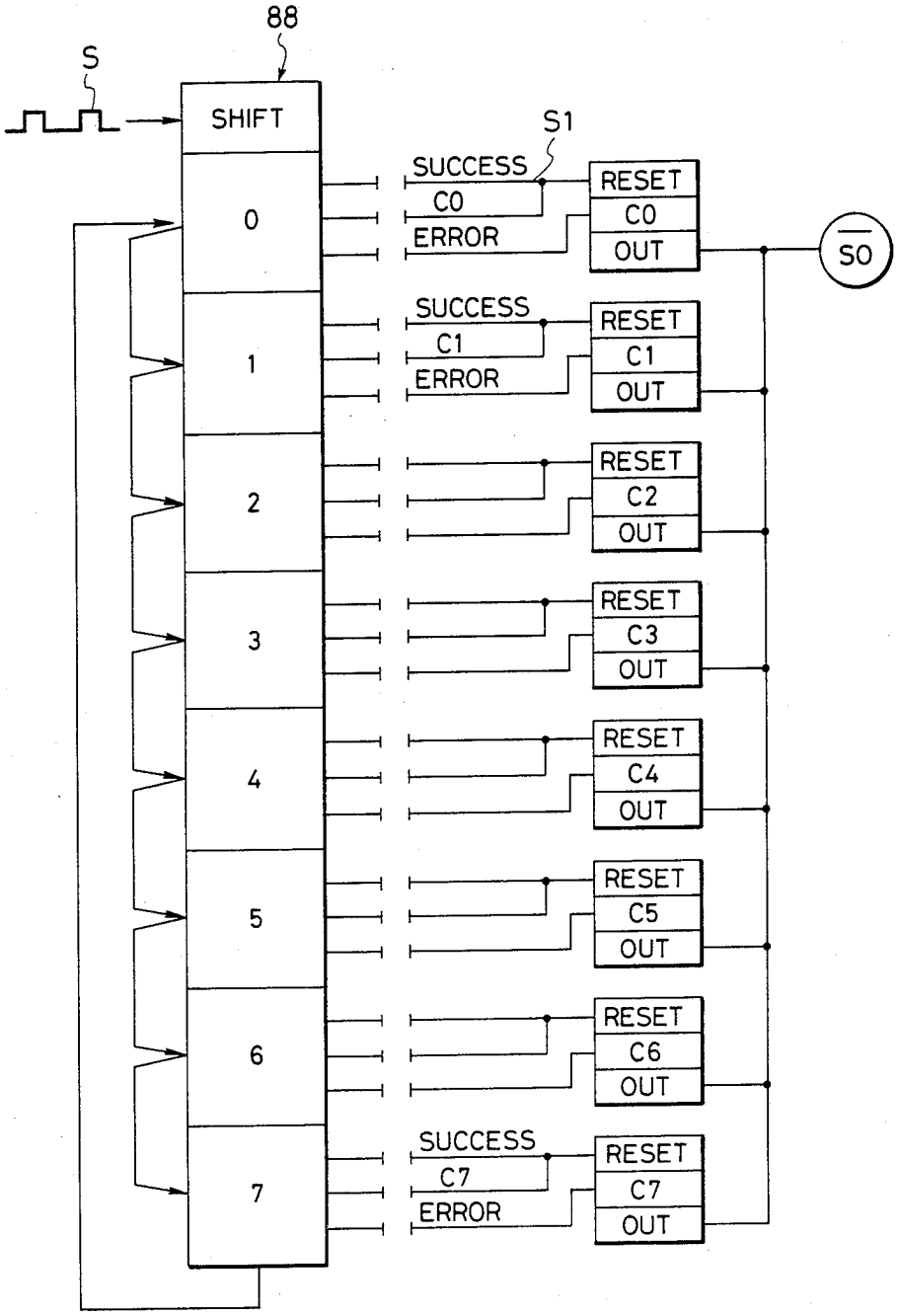

Next, when the rotary plate 4 is rotated one pitch, as shown in FIG. 7, a rotation signal S of the rotary plate switches the shift register to the register 1, and when an error in finding the yarn end occurs, the content of the counter C1 becomes "1". In this case also, the solenoid $\overline{so}$ is driven as above to bypass-feed the bobbin for which the yarn end finding operation has been unsuccessful.

When the rotary plate 4 is rotated and port 0 has arrived at station D, it is judged that the bobbin associated with the error in finding the yarn end has arrived at the station D, and a beater motor (51 in FIG. 5) is driven. Further, when port 0 arrives at the yarn end finding error detecting part, the shift register is switched back to register 0, and when an error in finding the yarn end occurs, the content of the counter C0 is incremented by "1" to be "2". In this case also, the solenoid $\overline{so}$ is driven to again bypass-feed the bobbin for which the error in finding the yarn end has been made for the second time.

Thus, when the content of the counter C0 becomes equal to the preset value "3", an output from the counter C0 is used as a solenoid drive inhibit signal, whereby the relevant bobbin is delivered to the feed line 7, and the counter C0 is reset.

However, when the yarn end finding operation has been successful in the second or third run, the content of the shift register is ANDed with a yarn end finding success signal S1, resulting in that the counter corresponding to the relevant port is reset, while the solenoid $\overline{so}$ is not driven, so that the bobbin for which the yarn end finding operation has been successful is delivered onto the feed line 7.

Thus, the bobbin can be circulated along the rotary plate to be subjected to the yarn end finding operation until the number of times of error in finding the yarn end reaches the preset number.

Figure 9:
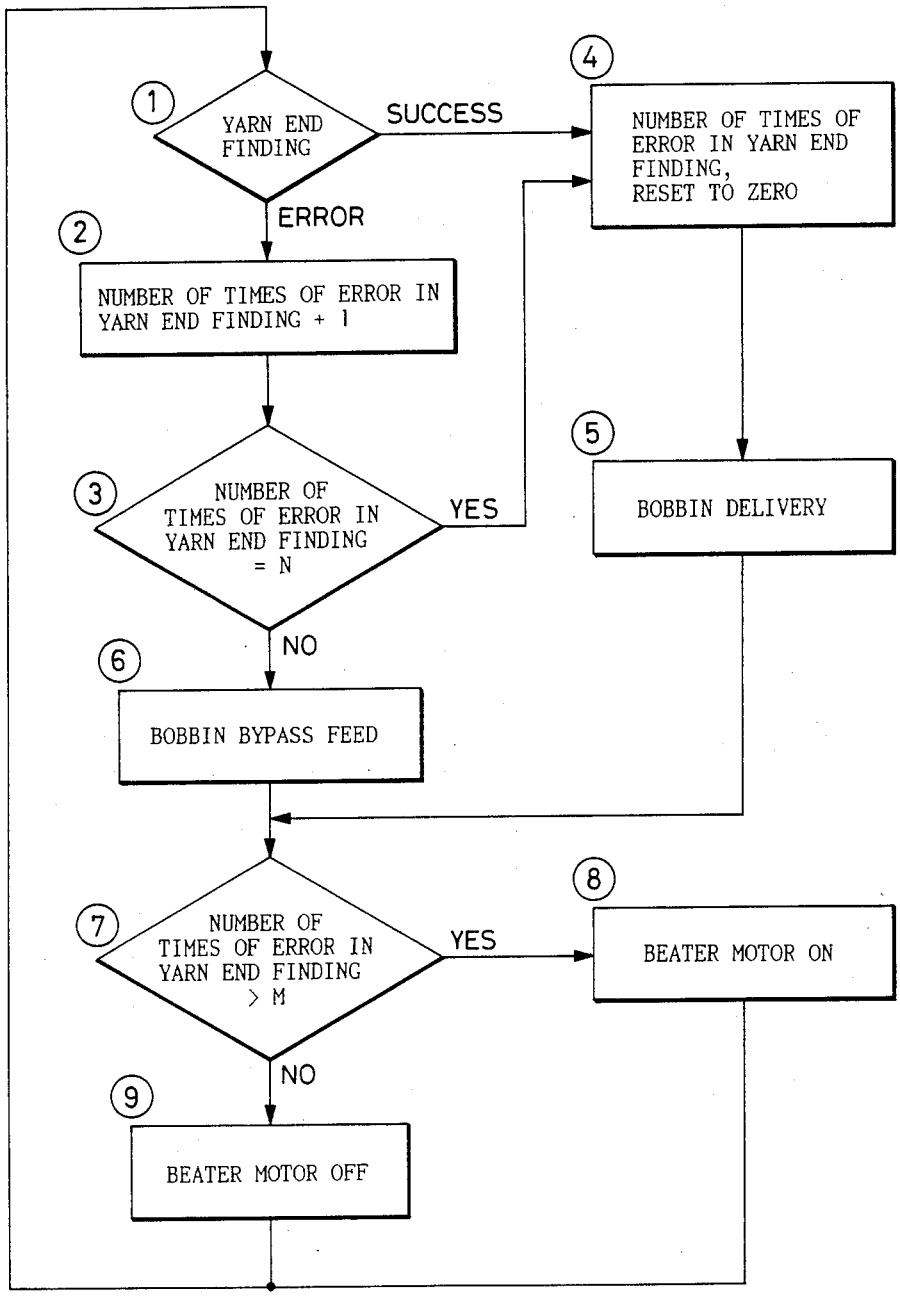

FIG. 9 shows a flow chart of the above operations. For example, whether the first-time yarn end finding operation has been successful or unsuccessful is judged (step ①), and in the case of the bobbin for which the yarn end finding has been unsuccessful, +1 is added to the number of times of error in finding the yarn end (step ②). The number of times of error is compared with an upper limit (N) of the number of times of allowable bypass feeding (step ③), and for the bobbin for which the number of times of error is equal to the upper limit or for which the yarn end finding has been successful, the number of time of error is reset to zero (step ④), and the bobbin is delivered to the feed line 7 at the delivery station (F in FIG. 1) (step ⑤).

On the other hand, the bobbin for which the number of times of error in finding the yarn end has not reached the upper limit is fed through the bypass circuit L2 (step ⑥), and the number of times of error is compared with the number of times of bypass feeding M which is a condition for driving the motor for the beater (step ⑦). For the bobbin supplied to the yarn end finding device for the first time as mentioned above, the number of times of bypass feeding M is zero, therefore the number of errors $1>0$, which satisfies the condition for driving the beater motor, and it is designated to drive the beater motor (step ⑧). On the other hand, for the bobbin for which the yarn end finding operation has been successful, the number of times of error in finding the yarn end is zero, and the condition for driving the beater motor (step ⑦) is not satisfied, so that the beater motor remains OFF (step ⑨).

Incidentally, although a system in which the stopper 58 is used for positioning the beaters 53, 54 when the beaters are not used, as shown in FIG. 4, has been described in the above example, any of various means is applicable such as one in which the position of the beater is detected and the beater is made to stand by at such a position as not contact the bobbin when the beater is not rotated, and one in which the whole beater device is mounted on a bracket capable of moving toward and away from the bobbin and the beater device is selectively set into a position for contacting the bobbin or a position for separating from the bobbin.

As stated hereinabove, according to the present invention the contacting device acts only on the bobbins for which the yarn end finding operation has been unsuccessful, so that the surface of the yarn layer on the bobbin which is passed through the yarn end finding device for the first time does not receive the action of the contacting device, the possibility of damages on the surfaces of the yarn layers is thus lowered, and bobbins of favorable quality can be supplied to the subsequent step.

What is claimed is:

1. A method for operating a yarn end finding apparatus, having a first device operable for drawing out a yarn end from a yarn layer wound on a spinning bobbin and a second device operable for loosening said yarn end by positively contacting the surface of said yarn layer, comprising the steps of:
   - operating said first device on said spinning bobbin;
   - detecting the success of the yarn end drawing out operation;
   - operating said second device in response to an unsuccessful yarn end drawing out operation.

2. A method as claimed in claim 1 further comprising the step of:
   - counting the number of unsuccessful yarn end drawing out operations performed on said spinning bobbin.

3. A method as claimed in claim 2, further comprising the step of:
   - removing said bobbin from the yarn end finding apparatus when said number of unsuccessful yarn end operations performed on said bobbin reaches a preset number.

4. A yarn end finding device for finding the yarn end of a yarn layer wound on a spinning bobbin, comprising:
   - an annular bobbin feed line, having a yarn finding line and a feed-back line, for transporting said bobbin;
   - a plurality of stations disposed adjacent the yarn finding line comprising:
     - a cutting and loosening station for cutting and loosening a bunch winding,
     - a yarn end sucking and loosening station,
     - a yarn end cutting and inserting station and
     - a delivery station;
   - a contacting device provided at the yarn end sucking and loosening station, for exerting a pulling force on said yarn end by contacting said yarn layer;
   - a sensor for detecting a found yarn end provided at the yarn end cutting and inserting station; and
   - a movable guide, positioned at the delivery station, having movement means, controlled by said sensor, for moving said movable guide so as to inhibit the delivery of a bobbin and to guide the bobbin into the feedback line if said sensor does not detect a yarn end.

5. A yarn end finding device as claimed in claim 4, further comprising:
   - signaling means, responsive to said sensor, for providing an error signal for said bobbin when said sensor does not detect a yarn end drawn out from said bobbin; and
   - a shift register for counting the number of error signals provided for said bobbin;
   - operating means for operating said contacting device in response to an error signal provided for said bobbin.

6. A yarn end finding device as claimed in claim 5, wherein said contacting device comprises:
   - a rotatable shaft;
   - a plurality of beaters comprising elastic friction members attached to the rotatable shaft, wherein the tips of the beaters intersect with the outer peripheral surface of said yarn layer during rotation of said rotatable shaft; and a stopper operable to prevent said beaters from contacting said surface of the yarn layer.

7. A yarn end finding device as claimed in claim 5, wherein said contacting device comprises:

a contacting member having a large coefficient of friction, for contacting with said yarn layer.

8. A yarn end finding device as claimed in claim 6, wherein said contacting member comprises:

a plurality of strips of friction material arranged in a row; and a shaft having an end portion on which said strips are connected.

9. A device for drawing out the yarn end on a layer of yarn wound about a spinning bobbin, comprising:

extracting means operable for drawing out yarn from a spinning bobbin;

detection means for detecting an unsuccessful drawing out operation; and separation means for separating said yarn end from said yarn layer in response to the detecting means detecting an unsuccessful drawing out operation.

10. A device for drawing out the yarn end on a layer of yarn wound about a spinning bobbin, comprising:

first and second means each operable for separating said yarn end from said yarn layer on a spinning bobbin located adjacent thereto;

detection means operable for detecting an unsuccessful separating operation performed by at least one of said first and said second separating means;

positioning means for performing a first positioning operation by positioning said spinning bobbin and said first separating means adjacent each other, and for performing a second positioning operation by positioning said spinning bobbin and said second separating means adjacent each other, said positioning means being responsive to the detection of an unsuccessful separating operation for performing said second positioning operation;

operating means for operating said first separating means following said first positioning operation and for operating said second separating means following said second positioning operation.

11. A device as in claim 10, wherein said operating means includes means for operating said second separating means in response to the detection of an unsucessful separating operation.

12. A device as in claim 10, wherein said positioning means comprises means for repeating said second positioning operation in response to the occurrence of an unsucessful separating operation performed by said second means.

13. A device as in claim 12, further comprising:

counting means for counting the number of said repeated positioning operations; and means for removing said spinning bobbin from the device when said number of repeated positioning operations reaches a preset number.

14. A device as in claim 9, wherein said extracting means comprises a suction device operable for imparting a suction force on said yarn end and said separation means comprises a contacting device operable for contacting said yarn layer.

15. A method of finding a yarn end on a yarn layer wound on a bobbin, said method comprising the steps of:

attempting to separate said yarn end and said yarn layer by subjecting said yarn layer to the action of a separating device, detecting whether said yarn end and said yarn layer have been separated by said separating device, and applying a contact force to said yarn layer to separate said yarn end and said yarn layer upon the detection of a failure of said separating device to separate said yarn end and said yarn layer.

16. A method of finding a yarn end on a yarn layer wound on a bobbin, said method comprising the steps of:

subjecting said yarn layer to the action of a separating device for separating said yarn end and said yarn layer, detecting whether said yarn end and said yarn layer have been separated by said separating device; and applying a contact force to said yarn layer to separate said yarn end and said yarn layer in response to detecting a failure of said separating device to separate said yarn end and said yarn layer.

* * * * *